US005225246A

United States Patent [19]

Beers et al.

[11] Patent Number: 5,225,246

[45] Date of Patent: Jul. 6, 1993

[54] METHOD FOR DEPOSITING A VARIABLE THICKNESS ALUMINIDE COATING ON AIRCRAFT TURBINE BLADES

[75] Inventors: Russell A. Beers, West Palm Beach; Allan A. Noetzel, Palm Beach Gardens, both of Fla.

[73] Assignee: United Technologies Corporation, Hartford, Conn.

[21] Appl. No.: 818,022

[22] Filed: Jan. 8, 1992

Related U.S. Application Data

[63] Continuation-in-part of Ser. No. 523,945, May 14, 1990, abandoned.

[51] Int. Cl.[5] ..... C23C 16/00

[52] U.S. Cl. ..... 427/252; 427/253; 427/282; 29/889.7

[58] Field of Search ..... 29/889.7, 889.71; 427/253, 252, 282, 404

[56] References Cited

U.S. PATENT DOCUMENTS 3,486,927 12/1969 Gauje ..... 427/253

4,469,719 9/1984 Martin ..... 427/282

*Primary Examiner*—Michael Lusigan

*Assistant Examiner*—Benjamin L. Utech

[57] ABSTRACT

A method for coating articles, such as gas turbine blades, with a coating of variable thickness by securing a shield having one or more holes extending therethrough to the article thereby defining a shielded portion of the article, exposing the article and shield to a metal-bearing gas which is circulated around the article to deposit a metallic coating thereon, wherein the circulation of the gas adjacent the shielded portion of the article is restricted by the presence of the shield, thereby producing a substantially thinner coating on the shielded portion of the article than on the unshielded portion.

3 Claims, 1 Drawing Sheet

METHOD FOR DEPOSITING A VARIABLE THICKNESS ALUMINIDE COATING ON AIRCRAFT TURBINE BLADES

The invention was made under a U.S. Government contract and the Government has rights herein.

CROSS REFERENCE TO RELATED APPLICATION

This is a continuation-in-part of U.S. patent application Ser. No. 07/523,945, filed May 14, 1990, now abandoned.

TECHNICAL FIELD

The present invention relates to coating articles, and more particularly, to an apparatus and method for producing gas phase deposition metallic coatings of variable thickness.

BACKGROUND ART

The aluminizing process is well known for improving the oxidation and corrosion resistance of many substrates such as alloys containing chromium, iron, nickel, or cobalt, as the major constituent. In particular, aluminide coatings are known to improve the oxidation and corrosion resistance properties of the nickel-and-cobalt-based superalloys which are used in high-temperature environments, such as gas turbine blades and vanes.

In one typical coating process, the article to be coated is embedded in a powder pack containing powdered aluminum, either as the metal, an alloy, or a compound such as cobalt, a carrier, typically an ammonium or alkali metal halide, and an inert filler such as aluminum oxide. Once embedded, the article is heated to between 1400° F. and 2200° F., depending on the particular coating material, with the thickness of the coating depending on the temperature and the duration of the exposure. The halide acts as a carrier or activator to facilitate the transfer of the aluminum from the powder pack to the exposed surface of the article, where the aluminum is deposited. At the surface of the article, the aluminum and the substrate material interdiffuse to form an aluminide coating, and the halide is freed to transport more aluminum from the powder pack to the article. As the coating thickness increases, the interdiffusion of the aluminum and the substrate decreases, thereby increasing the percent by weight of aluminum in the aluminide coating.

Another coating process, referred to as out-of-pack gas phase deposition of aluminized coatings, is described in U.S. Pat. Nos. 3,486,927 and 4,148,275, which are hereby incorporated by reference herein. This process is similar to the powder pack method except that the article is not embedded in the powder pack. Instead, the aluminum-bearing halide gas is circulated from the powder pack using an inert gas, and into contact with the article to effect an aluminum deposition on the exposed surfaces of the article, producing a coating of substantially uniform thickness thereon.

The out-of-pack process is very useful in applying aluminide coatings to the airfoil section of gas turbine blades. Turbine blades so coated demonstrate significantly greater oxidation and corrosion resistance than uncoated blades, increasing the useful life of the turbine blade. Since the protection from oxidation and corrosion provided by the aluminide coating is directly related to the thickness of that coating, it is desirable to further increase the thickness of the aluminide coating on the airfoil, where that protection is needed most.

However, as the thickness of the aluminide coating increases, the commensurate increase in the percent by weight of aluminum reduces the ductility of the coating. Due to the highly stressed nature of the turbine blade platform region adjacent the pressure side of the airfoil, the aluminide coating in this region becomes susceptible to fracturing during blade use if the coating thickness exceeds a maximum allowable thickness. The nature of this fracturing is such that cracks in the coating readily propagate into the substrate of the blade platform itself, reducing the integrity, and therefore the useful life, of the turbine blade.

Unfortunately, the aluminide coating thickness necessary to provide the desired oxidation and corrosion resistance on the airfoil is significantly greater than the maximum allowable coating thickness in the blade platform region adjacent the pressure side of the airfoil. Since the out-of-pack gas deposition method produces a coating of substantially uniform thickness, the aluminide coating thickness on the airfoil has heretofore been limited by the maximum allowable coating thickness in the blade platform region. Consequently, the oxidation and corrosion resistance of gas turbine blades and vanes of the prior art is significantly less than that which could be obtained if the blade platform coating thickness were not a limiting factor.

DISCLOSURE OF INVENTION

It is therefore an object of the present invention to provide an apparatus and method for coating an article with a coating of variable thickness.

Another object of this invention is to provide an apparatus and method for applying an increased durability metal coating to a turbine blade which does not promote crack formation in the region of the blade platform.

Another object of this invention is to provide an apparatus and method for coating a turbine blade with a metal coating which is thinner in the blade platform region adjacent the airfoil than the coating on the airfoil.

Another object of this invention is to provide an apparatus and method for coating a turbine blade with an aluminide coating in which the aluminum content in the blade platform region adjacent the airfoil is significantly less than the aluminum content of the coating on the airfoil.

According to the present invention, a shield is provided for use in coating articles with oxidation and/or corrosion resistant metals such as aluminum, chromium, and the like, by out-of-pack gas phase deposition. The shield restricts circulation of the metal-bearing deposition gas near those shielded surfaces of an article which are shielded by the shield, resulting in a thinner coating on those surfaces. Unshielded surfaces can thereby be coated to the desired thickness while the thickness of the shielded surfaces remains at or below the maximum allowable thickness.

For example, the present invention may be used to coat a gas turbine blade by extending the airfoil section through an aperture in the shield, the aperture being only slightly larger than the outer dimensions of the airfoil, and securing the shield in spaced, proximate relation to the blade platform. During out-of-pack gas phase deposition, the turbine blade is exposed to the circulating metal-bearing gas until a coating of the desired thickness builds up on the airfoil. Since the shield restricts circulation of the metal-bearing gas in the blade platform region, the coating on the platform is significantly thinner and more ductile than the coating on the airfoil. The resulting variable thickness coating exhibits the desired oxidation and/or corrosion resistance on the airfoil while providing the ductility necessary on the blade platform region to avoid crack formation therein.

The foregoing and other features and advantages of the present invention will become more apparent from the following description and accompanying drawings.

BEST MODE FOR CARRYING OUT THE INVENTION

Figure 1:
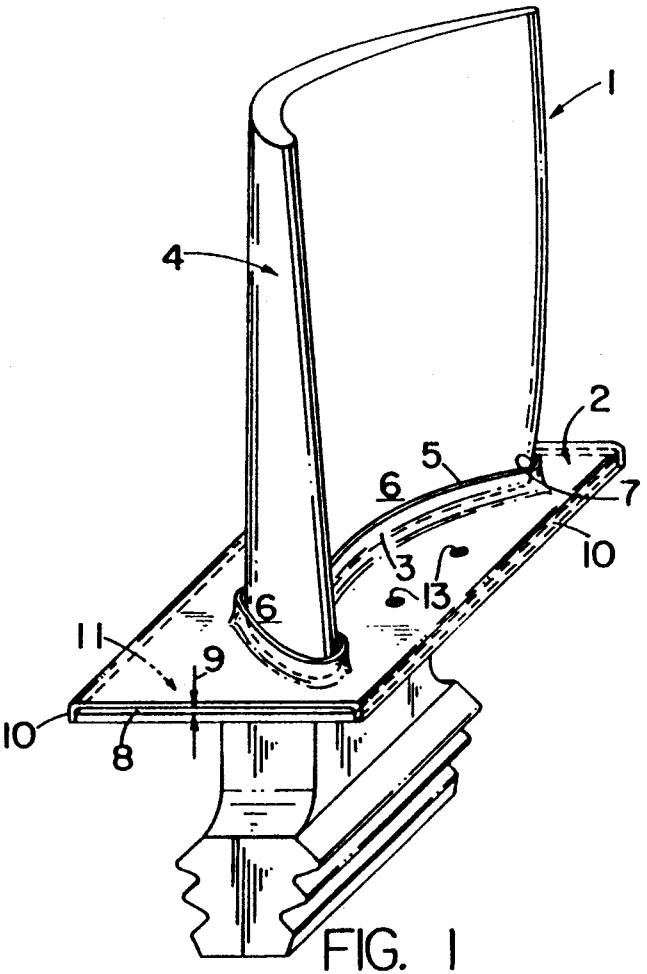
FIG. 1 is a perspective view of a turbine blade with a shield device of the present invention attached.

Shown in FIG. 1 is a turbine blade 1 with a shield 2 of the present invention attached thereto. The shield 2 is preferably constructed of a 0.025 inch (0.64 mm) thick sheet of Hastelloy X, a trademark of Union Carbide Corporation, Danbury, Conn., for an alloy containing by weight approximately 48.3% nickel, 22.0% chromium, 1.5% cobalt, 0.10% carbon, 18.5% iron, 9.0% molybdenum, and 0.6% tungsten. Although Hastelloy X is the preferred material for construction of the shield 2, it will be apparent to those skilled in the art that other materials which can withstand the gas phase deposition temperatures may be used as well. The shield 2 includes an aperture 3 through which the airfoil section 4 of the turbine blade 1 extends. The edge 5 of the shield 2 is shaped to conform to the contours of the airfoil surface 6. The aperture 3 is slightly larger than is necessary to receive the airfoil 4, and the airfoil 4 is centered within the aperture 3 so that the edge 5 of the aperture 3 is in spaced relation to the airfoil surface 6. A gap 7 is thus defined between the airfoil surface 6 and the edge 5 of the aperture 3, the gap 7 being substantially uniform along the length of the edge 5.

The shield 2 is secured in fixed, spaced relation to the platform surface 8, so that the separation 9 between the shielded portion of the platform surface 8 and the shield 2 is approximately 0.022 inches (0.56 mm). Although a separation 9 of 0.022 inches is preferred for the present example, a larger or smaller separation 9 may be used depending on whether a thicker or thinner coating, respectively, is desired. As those skilled in the art will readily appreciate, since the percent by weight of aluminum increases with increasing aluminide coating thickness, increasing the separation 9 increases the percent by weight of aluminum in the aluminide coating on that portion of the turbine blade 1 shielded by the shield 2.

To secure the shield 2 in fixed relation to the turbine blade 1, the shield 2 is preferably tack welded to edges 10 of the platform 11 which will eventually be machined off. However, the shield 2 may be secured to any structure which can support the shield in fixed relation to the platform surface 8. Additionally, holes 13 approximately 0.025 inches (0.64 mm) in diameter may be strategically placed in the shield 2 to prevent bare spots in the coating on the platform surface 8 due to excessive shielding. The holes 13 in the shield 2 allow the metal-bearing gas to pass through the shield 2 at the holes 13, thereby increasing the circulation of the metal-bearing gas to the shielded portion of the blade platform 8 immediately adjacent the holes 13. As is readily apparent to those skilled in the art, this greater circulation provides a thicker aluminide coating on the platform 8 immediately adjacent the holes 13, allowing the shield 2 to be tailored to produce the desired coating thickness variations on the surface of the platform 8.

Figure 2:
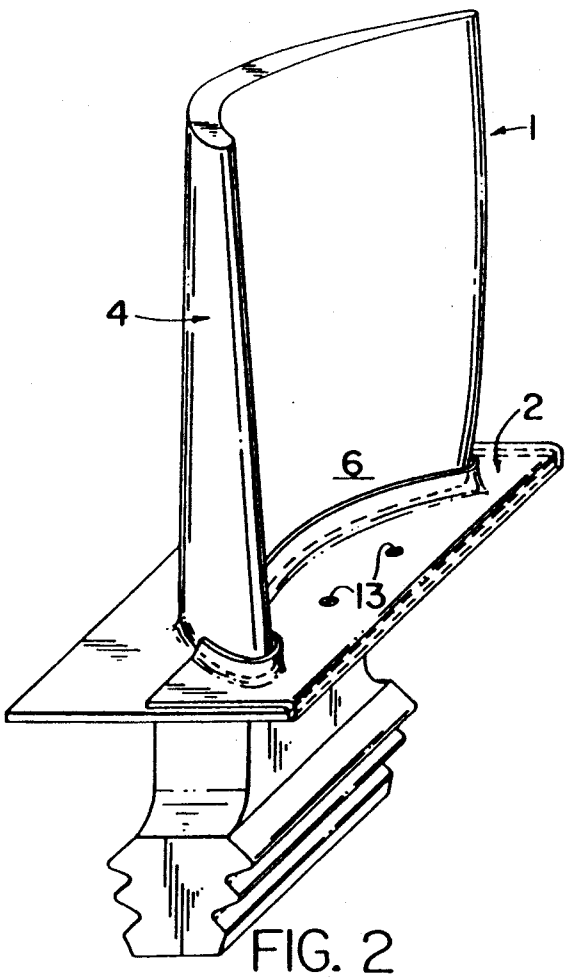
FIG. 2 is a perspective view of a turbine blade with an alternative embodiment of the present invention attached.

Although the shield 2 as shown in FIG. 1 shields substantially all of the blade platform surface, it may be desirable to provide a reduced thickness coating on only the high pressure side of the blade platform. FIG. 2 shows an embodiment of the shield 2 of the present invention which shields only the high pressure side of blade platform, leaving the low pressure side of the blade platform exposed. This embodiment is similar to the embodiment shown in FIG. 1, except that the low pressure side of the shield has been removed. Those skilled in the art will recognize that the embodiment shown in FIG. 1 could be modified to include holes 13 on the low pressure side of the shield 2, or the gap 5 between the edge 3 and the low pressure side of the airfoil surface 6 could be substantially increased, either of which would reduce the shielding effect of the low pressure side of the shield 2, producing a thicker coating thereon.

The shield 2 may be formed by cutting a blank of Hastelloy X to form an aperture 3 nearly the shape of the airfoil surface 6 contours, and drilling the holes 13. The blank may then be stamped by known sheet metal processes to form the final shape of the shield 2. A shim of 0.022 inches (0.56 mm) may then be placed on the platform surface 8 between the shield 2 and the platform surface 8 to provide the desired separation 9. With the shim in place, the shield 9 may be tack welded to at least one edge 10 of the platform 11, and the shim removed.

Alternatively, the shield 2 may be made by casting, or any other appropriate metal-forming process known in the art. Likewise, the shield 2 may be part of a reusable mechanical mask which is secured to the turbine blade 1 by means which do not require the destruction of the shield 2 after one use. Once the shield 2 is secured in fixed relation to the turbine blade 1, both may be placed in a coating apparatus similar to that used in the out-of-pack process discussed above. The blade 1 is then heated to a temperature in excess of 1700° F. and aluminum deposition gas is introduced into the apparatus and circulated therein. The circulating gas flows into contact with the airfoil surface 6 and, to a lesser extent, through the holes 13 to the shielded portion of the platform surface 7. Since the aluminum deposition gas deposits aluminum according at a rate proportional to the amount of circulation of the aluminum deposition gas, the circulating gas deposits a greater amount of aluminum on the airfoil surface 6 than on the shielded portion of the blade platform 7.

Test results show that the aluminide coating on a turbine blade is 0.5 to 1.2 mils (0.01 to 0.03 mm) thinner on the shielded section of the platform 7 than on the unshielded portions of the turbine blade, which have an aluminide coating thickness of 3.5 mils (0.09 mm). In addition to being significantly thinner than the coating on the airfoil 4, the coating on the platform surface 7 has a typical aluminum content of approximately 18% by weight as compared to approximately 23% by weight aluminum content in the airfoil section coating. As with many aluminides, a higher aluminum content equates with a lower level of ductility, and a brittle coating may be more susceptible to cracking. Therefore, lower aluminum content of the thinner platform coating provides the oxidation and corrosion resistance desired on the blade platform, while at the same time providing sufficient ductility to withstand operational stresses without promoting crack growth in the blade platform substrate.

Although this invention has been shown and described with respect to detailed embodiments thereof, it will be understood by those skilled in the art that various changes in form and detail thereof may be made without departing from the spirit and scope of the claimed invention.

We claim:

1. A method of producing a coating of variable thickness on an exposed surface of a turbine blade, said exposed surface having a shielded portion and an unshielded portion, said method comprising:

providing a shield for partially shielding said shielded portion of said exposed surface from a metal-bearing gas, said shield including at least one hole to allow said metal-bearing gas to pass therethrough and an edge which conforms to contours of said exposed surface;

securing said shield in fixed, and spaced, relation to said shielded portion of said exposed surface, defining a shielded region therebetween;

placing said turbine blade into a coating apparatus;

heating said turbine blade in said coating apparatus to a temperature in excess of 1700° F.;

introducing said metal-bearing gas into said coating apparatus; and, circulating said metal-bearing gas into contact with said shielded portion and said unshielded portion providing a metal coating thereon, whereby circulation of said gas into said shielded region is so restricted that said metal-bearing gas deposits a thinner coating on said shielded portion than on said unshielded portion of said exposed surface.

2. The method of claim 1 further comprising using aluminum-bearing gas as the metal-bearing gas, and spacing said shield from said shielded portion a distance sufficient to produce a maximum aluminum content by weight on said unshielded portion and said shielded portion has a minimum aluminum content by weight, wherein said minimum aluminum content is not more than 85% of said maximum aluminum content.

3. The method of claim 1 further comprising using aluminum-bearing gas as the metal-bearing gas, and spacing said shield from said shielded portion a distance sufficient to produce an aluminum content by weight of approximately 23% in said coating on said unshielded portion, and an aluminum content by weight of approximately 18% in said coating on said shielded portion.

* * * * *